US011175023B2

(12) United States Patent
Jones

(10) Patent No.: US 11,175,023 B2
(45) Date of Patent: Nov. 16, 2021

(54) FIXTURE MOUNTING SYSTEM AND METHOD

(71) Applicant: SIGNIFY HOLDING B.V., Eindhoven (NL)

(72) Inventor: Mark Owen Jones, South Dartmouth, MA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 52 days.

(21) Appl. No.: 16/326,254

(22) PCT Filed: Jul. 28, 2017

(86) PCT No.: PCT/EP2017/069148
§ 371 (c)(1),
(2) Date: Feb. 18, 2019

(87) PCT Pub. No.: WO2018/041495
PCT Pub. Date: Mar. 8, 2018

(65) Prior Publication Data

US 2019/0195475 A1 Jun. 27, 2019

Related U.S. Application Data

(60) Provisional application No. 62/380,803, filed on Aug. 29, 2016.

(30) Foreign Application Priority Data

Sep. 22, 2016 (EP) ..... 16190052

(51) Int. Cl.
*F21V 21/04* (2006.01)
*E04B 9/00* (2006.01)
(Continued)

(52) U.S. Cl.
CPC ..... *F21V 21/04* (2013.01); *E04B 9/006* (2013.01); *F21S 8/026* (2013.01); *F21V 21/041* (2013.01);
(Continued)

(58) Field of Classification Search
CPC ..... F21V 21/04; F21V 21/048; F21V 21/047; F21V 21/041; F04D 29/601;
(Continued)

(56) References Cited

U.S. PATENT DOCUMENTS 1,982,957 A * 12/1934 Knell ..... H02G 3/126 220/3.9
4,803,603 A * 2/1989 Carson ..... F21V 21/04 362/150
(Continued)

FOREIGN PATENT DOCUMENTS

WO 2007109839 A1 10/2007
WO 2015161342 A1 10/2015

*Primary Examiner* — Eret C McNichols
(74) *Attorney, Agent, or Firm* — Daniel J. Piotrowski

(57) ABSTRACT

A mounting bracket (20) for a luminaire fixture frame (12) having one or more tabs (30) to engage a hat channel or the like. The one or more tabs (30) are positionable between an un-deployed position and a deployed position to operably engage the hat channel.

9 Claims, 5 Drawing Sheets

(51) Int. Cl.
*F21S 8/02* (2006.01)
*F21Y 115/10* (2016.01)
*F21Y 115/15* (2016.01)

(52) U.S. Cl.
CPC ..... *F21Y 2115/10* (2016.08); *F21Y 2115/15* (2016.08)

(58) Field of Classification Search
CPC .... F04D 29/646; F04D 29/624; F04D 29/626; F04D 25/12; F04D 25/088; H02G 3/125; E04B 9/006; F21S 8/026; F21Y 2115/10; F21Y 2115/15
See application file for complete search history.

(56) References Cited

U.S. PATENT DOCUMENTS 5,386,959 A * 2/1995 Laughlin ..... H02B 1/015 248/200.1
5,505,419 A * 4/1996 Gabrius ..... H02G 3/125 248/343
5,588,737 A 12/1996 Kusmer
5,720,460 A 2/1998 Watson
5,758,959 A * 6/1998 Sieczkowski ..... F21S 8/026 362/148
5,938,157 A * 8/1999 Reiker ..... E04B 9/006 156/71
6,033,098 A * 3/2000 Hentz ..... B62J 6/00 248/228.7
6,286,265 B1 * 9/2001 Rinderer ..... E04B 9/006 52/28
6,967,284 B1 * 11/2005 Gretz ..... H02G 3/125 174/50
7,673,841 B2 * 3/2010 Wronski ..... F16M 13/027 248/343
7,874,708 B1 1/2011 Jones et al.
8,800,943 B2 * 8/2014 Long ..... F04D 29/601 248/200.1
9,060,607 B1 6/2015 Canales
9,194,602 B2 * 11/2015 Hu ..... F24F 13/20
9,261,120 B2 * 2/2016 Colangelo ..... H02G 3/12
10,541,522 B2 * 1/2020 Lalancette ..... H02G 3/281
2007/0075206 A1 * 4/2007 Wright ..... F04D 25/088 248/343
2007/0131827 A1 * 6/2007 Nevers ..... F21V 21/04 248/201
2008/0011928 A1 * 1/2008 Adrian ..... H02G 3/20 248/343
2009/0231861 A1 * 9/2009 Wedekind ..... H02G 3/20 362/365
2011/0073017 A1 * 3/2011 Wilson, Jr. ..... F16M 5/00 108/42
2012/0044704 A1 2/2012 Wilson
2015/0060638 A1 * 3/2015 Hu ..... F24F 13/20 248/674
2015/0252988 A1 9/2015 Rashid
2017/0307188 A1 * 10/2017 Oudina ..... F21V 21/04
2018/0119907 A1 * 5/2018 O'Brien ..... F21S 8/026
2019/0331362 A1 * 10/2019 Gao ..... F16M 13/027

* cited by examiner

FIXTURE MOUNTING SYSTEM AND METHOD

CROSS-REFERENCE TO PRIOR APPLICATIONS

This application is the U.S. National Phase application under 35 U.S.C. § 371 of International Application No. PCT/EP2017/069148, filed on Jul. 28, 2017 which claims the benefit of U.S. Provisional Patent Application No. 62/380,803, filed on Aug. 29, 2016, which claims the benefit of European Patent Application No. 16190052.7, filed Sep. 22, 2016. These applications are hereby incorporated by reference herein.

TECHNICAL FIELD

The present invention is directed generally to luminaire mounting system. More particularly, various inventive methods and apparatus disclosed herein relate to a recessed luminaire fixture frame mounting system.

BACKGROUND

In the construction of buildings, it is known to install suspended ceilings beneath water pipes, heating ducts, and electrical races in order to concealing them from normal activity within a building or room. Typically, these systems fix ceiling material to a grid-work of channels and overhead structure. These systems use clips and hangers in order to suspend a grid of furring/hat channels below a supporting structure that can be then sheeted with an appropriate ceiling material such as plasterboard or sheetrock. This allows the designer to bring the ceiling level down to the required height and provides space in the ceiling cavity for utilities or other services.

In mounting light fixtures to the furring/hat channel grid, various known light fixtures require the use of multiple tools in order to connect hanger bars to the grid formed of the plurality of steel U-shaped channels. For example, current mounting systems require the user to install with additional screws and/or steel wire to attach the frame in kit. In addition, additional hardware and/or steel wire may be needed for vertical adjustment of the frame to bring to the level of the bottom of the channel, which will become the top surface of the ceiling material. This may be time consuming and difficult as well. Such activities are difficult in and of themselves, however, when working at or above the ceiling level on a ladder may also increase the difficulty of the task. It would be desirable to design a fixture which is mountable in a furring/hat channel grid system without or minimizing the use of tools or additional hardware. It would also be desirable to mount with channels of different heights and/or place the frame in kit at the correct height relative to the top surface of the ceiling material without or minimizing adjustment. It would also be desirable to decrease the number of connections necessary to install a recessed lighting system to a furring/hat channel grid system while allowing quick, consistent, and stable installation.

Given the foregoing, it will be appreciated that a luminaire mounting assembly is needed which at least may overcome the aforementioned deficiencies.

U.S. Pat. No. 5,588,737 relates to a recessed light fixture that includes a neuter plaster frame with which is attached components to customize the fixture to specific installations. The components include a junction box with a face plate attachable thereto that has different electrical elements mounted thereon, such as transformer and thermal protectors, a ballast mounting plate that fastens onto the plaster frame by an arrangement of legs and spring clips, and a trim ring that accommodates to the thickness of the ceiling. The bulb socket is held in a socket cup that is fitted with different socket holders depending on the size and shape of the socket, and the hanger bars for the supporting the plaster frame in the ceiling are adaptable for mounting on wood joists or metal suspended ceiling grids.

SUMMARY

The present disclosure is directed to inventive methods and apparatus for a mounting bracket for a luminaire fixture frame having one or more tabs to engage a hat channel or the like. The one or more tabs are positionable between an un-deployed position and a deployed position to operably engage the hat channel. The tabs may allow mounting to channels of one or more heights and/or place the frame at a desired height relative to the ceiling material without or minimizing adjustment. For example in some embodiments, the mounting bracket may permit mounting to a furring/hat channel grid system without or minimizing the use of tools or additional hardware.

Generally, in one aspect, an embodiment of the hat channel mounting bracket for a luminaire fixture frame may include a bracket that has an elongated body with opposing ends, a tab connected to each opposing end by a living hinge, and wherein each tab includes one or more slots. Each tab with one or more slots may be positionable from an un-deployed position to a deployed position about the living hinge such that when in the un-deployed position the one or more slots of each tab are disengaged from a hat channel. Further, when in the deployed position the one or more slots of each tab engages a hat channel. In various embodiments, when in the un-deployed position each tab may be substantially in a vertical plane of the elongated body and when in the deployed position each tab may be substantially transverse to the vertical plane of the elongated body. In some embodiments, each tab may include a lever. In various embodiments, each tab may pivot in a direction opposite relative to each other about the living hinge when positioning from the un-deployed position to the deployed position. In some embodiments, one or more slots may be adjacent a distal free end of the tab opposite the living hinge. In various embodiments, the tab may include one or more ribs. In various embodiments, the hat channel mounting bracket may include a clip and a fastener, wherein the clip is vertically adjustable relative to the bracket, the clip extends through a slot within the elongated body of the bracket, and the fastener extends through the bracket and the clip to engage a hat channel. Further, the clip may engage at least one of an upper edge or one or more transverse slots of the slot thereby corresponding to one or more slots of each tab. In some embodiments, the one or more slots of the tabs open onto two opposing surfaces of each tab and onto an outer surface of the tab.

In various embodiments, a luminaire fixture assembly for a luminaire may include a first bracket that has an elongated body with opposing ends, a tab connected to each opposing end, and each tab includes one or more slots. Further each tab with one or more slots may be positionable from an un-deployed position to a deployed position, wherein when in the un-deployed position the one or more slots of each tab is disengaged from a first hat channel. Further, when in the deployed position the one or more slots of each tab engages the first hat channel. In some embodiments, luminaire fixture assembly may include a second bracket that has an elongated body with opposing ends, a tab connected to each opposing end, and wherein each tab includes one or more slots. Further each tab with one or more slots may be positionable from an un-deployed position to a deployed position, wherein when in the un-deployed position the one or more slots of each tab is disengaged from a second hat channel. Further, when in the deployed position the one or more slots of each tab engages the second hat channel. In some embodiments, one or more hanger bars space the first bracket from the second bracket. In various embodiments, a fixture frame may be disposed between the first bracket and the second bracket. In various embodiments, when in the un-deployed position each tab of the first bracket may be substantially in a vertical plane of the elongated body, and when in the deployed position each tab may be substantially transverse to the vertical plane of the elongated body. Further in some embodiments, when in the un-deployed position each tab of the second bracket may be substantially in the vertical plane of the elongated body, and when in the deployed position each tab may be substantially transverse to the vertical plane of the elongated body. Further in some embodiments, each one of the first bracket and the second bracket may include a clip and a fastener. In some embodiments, the clip engages each of the first bracket and the second bracket at a corresponding position relative to one or more slots of each tab. In various embodiments, the tabs of each one of the first bracket and the second bracket includes a lever. Further, the lever may be positioned above the elongated body. In some embodiments, the tabs of each one of the first bracket and the second bracket may include one or more ribs. In various embodiments, the tabs of each one of the first bracket and the second bracket may be connected to the opposing ends of the elongated body by a living hinge extending from an upper edge to a lower edge of the elongated body. In some embodiments, the one or more slots of the tabs open onto two opposing surfaces of the tab and onto an outer surface of the tab.

Generally, in another aspect, a method of mounting a luminaire may include one or more of the following steps: providing a pair of elongated brackets spaced apart by one or more hanger bars and each end of the elongated bracket may include a hinged tab, wherein a distal free end of the tab may be interrupted by one or more slots; deploying the tabs with the distal free end interrupted by one or more slots from a first position to a second position; and receiving a flange of a hat channel within at least one of the one or more slots of each tab when in the second position. In various embodiments, the method may include the step of locking the pair of elongated brackets to a hat channel when in the second position. Further, the step of locking the pair of elongated brackets to a hat channel may include a clip and a fastener. Further, the clip may engage the bracket at a position corresponding to at least one slot that receives the flange. In various embodiments, the method may include the step of deploying the tabs manually by hand. Further in some embodiments, the clip and fastener may be secured manually by hand. In some embodiments, the step of deploying the tabs may include operating a lever of the tab. In various embodiments, the method may include the step of adjusting a fixture frame between the pair of elongated brackets. In some embodiments, the step of deploying the tabs may include pivoting a first portion of at least one tab outwardly and away from the other elongated bracket and a second portion of at least one tab inwardly and towards the other elongated bracket.

In various embodiments, a hat channel mounting bracket for a luminaire fixture frame may include a bracket that has an elongated body with opposing ends, a tab connected to each opposing end by a hinge, and wherein each tab includes one or more slots interrupting a distal free end opposing the hinge. Further in some embodiments, each tab may include a lever. In some embodiments, each tab with one or more slots may be positionable from an un-deployed position to a deployed position about the hinge. When in the un-deployed position the one or more slots of each tab may be disengaged from a hat channel less than when the one or more slots of each tab engages a hat channel in the deployed position. In some embodiments, an overall length of the bracket may be smaller when in the deployed position than in the un-deployed position. In various embodiments, each tab may include a pair of adjacent fingers spaced apart from each other to define at least one slot. In some embodiments, the bracket may include a clip, wherein the clip engages the bracket at a corresponding position relative to one or more slots.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radio luminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g., for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

More generally, Applicants have recognized and appreciated that it would be beneficial to have a hat channel mounting bracket that can engage one or more heights of a variety of hat channels and properly position the fixture frame.

In view of the foregoing, various embodiments and implementations of the present invention are directed to brackets 20 with deployable tabs 30 with one or more receiving slots 40 to engage a furring/hat channel C or the like.

Referring to FIGS. 1-4A, in one embodiment, one or more elongated mounting brackets 20 may be included to engage the hat channel C to position a fixture frame 12 relative to a bottom B of a hat channel C and/or ceiling material M. Specifically, one or more tabs 30 of the brackets 20 deploy to engage the respective hat channel C of a variety of heights H. It should be understood that opposing brackets 20 may be formed of one or more of the same elements as shown in the embodiment or alternatively be different from one another.

Figure 4:
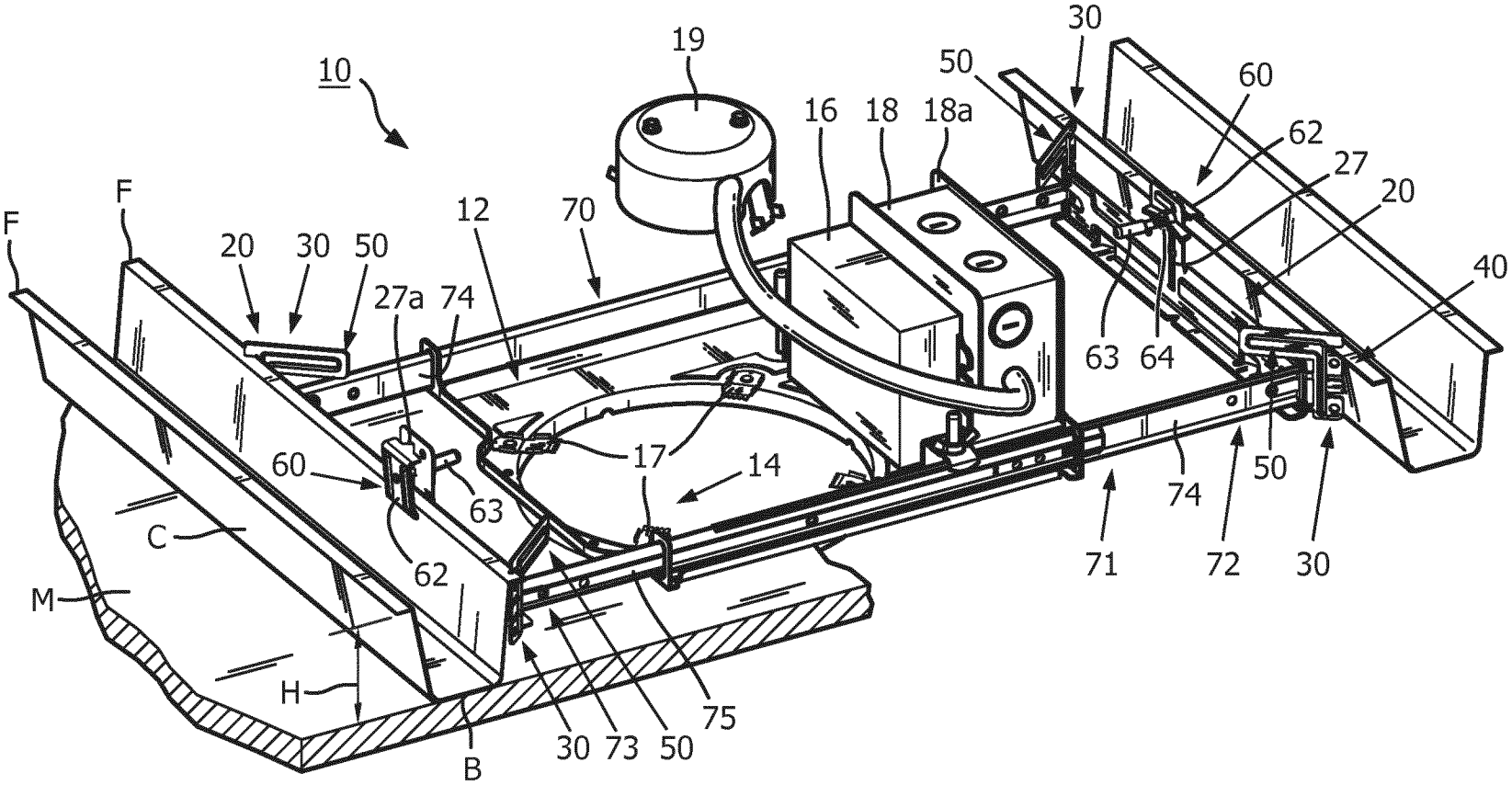
FIG. 4 is a perspective view of an embodiment of a hat channel luminaire fixture assembly for a luminaire fixture, illustrating the bracket in the deployed position engaging one side of the hat channel.

As shown in FIGS. 1-4A, the tabs 30 of the brackets 20 may extend from opposing ends, a first end 21 and a second end 22, of an elongated body 23. Tabs 30 may be in a variety of positions relative to the elongated body 23. For example portions of the elongated body 23 may extend horizontally and/or vertically beyond the outer extent or periphery of one or more portions of the tabs 30. The elongated bracket 20 may be substantially horizontal when hung on the hat channel C as shown in FIG. 4. The elongated body 23 is orientated in a substantially vertical plane between an upper edge 23*a* and a lower edge 23*b*. Between the upper edge 23*a* and lower edge 23*b*, may be opposing sides 23*c* and 23*d*. A first side 23*c* is outwardly facing away from the fixture frame 12 and the second side 23*d* is inwardly facing towards the fixture frame 12. Although the bracket is shown in detail in the figures, it is merely representative of some embodiments, and it is to be understood that there are a variety of shapes, sizes, orientations, constructions, and quantities which may be used and still be within the scope of the teachings herein.

Each of the tabs 30 include one or more slots 40 therein to engage the hat channel C in a deployed position as shown in FIG. 4. As shown in FIG. 4, when the bracket 20 is engaged to the hat channel C, one or more of the slots 40 of the tab 30 may receive a portion of the outer projecting flange F at the upper portion of the U-shaped hat channel C. As a result the one or more brackets 20 are maintained in a vertical and/or horizontal position relative to the hat channel C. In one embodiment, the tab 30 includes a proximal end 31 connected to or adjacent the first end 21 of elongated body 23 and an opposing distal free end 32. The proximal end 31 of the tab 30 is adjacent one or more hinges 33. The hinge 33 may be a living hinge as shown in the embodiments. However, a variety of hinge constructions, quantities, orientations, shapes, sizes are contemplated and still be within the scope of the teachings herein. The distal free end 32 of the tab 30 includes one or more slots 40. The slots 40 interrupt the distal free end 32 of the tab 30 creating one or more fingers 34 defining the slots 40. In one embodiment, the slot 40 opens on the two opposing surfaces, inside surface 30*a* and outside surface 30*b*, of the tab 30 and the outer face or surface 30*c* of the tab 30. Each slot 40 may have an interior bottom 41, an interior top surface 42, and an opposing interior bottom surface 43. The slots 40 may be spaced from each other along the direction of the outer surface 30*c* or vertically from the lower end of the tab towards the upper end of the tab. As is shown in one embodiment, the lower end of the tab is substantially flush with the lower edge 23*b* of the elongated body 23, however the upper end of the tab extends above the upper edge 23*a* of the elongated body 23. Although the tabs and/or slots are shown in detail in the figures, it is merely representative of some embodiments, and it is to be understood that there are a variety of shapes, sizes, orientations, constructions, and quantities which may be used and still be within the scope of the teachings herein. For example, the slots may be a variety of shapes and still engage the flange of the hat channel. In some embodiments for example, the bracket may have more than one tab with slots on a respective end that may be hinged separately from each other. Further in some embodiments, the hinge may be orientated other than substantially vertical as is shown.

Figures 5, 5A:
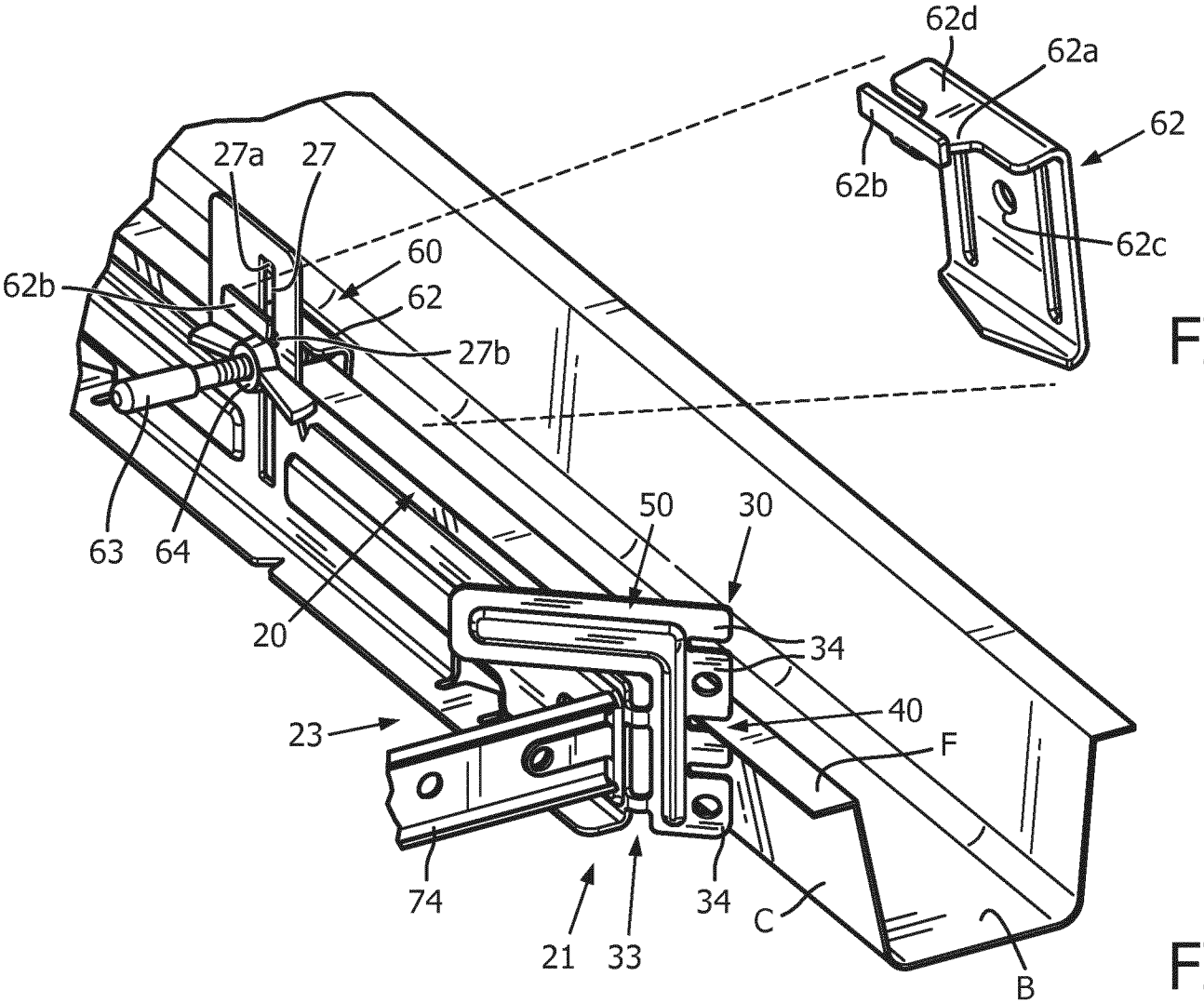
FIG. 5 is an enlarged perspective view of a bracket tab in the deployed position engaging the hat channel, illustrating a different slot of the tab and clip position used in an application of a hat channel embodiment with a height different or smaller than the hat channel embodiment of FIG. 4 to properly position the fixture frame relative to the bottom of the hat channel and/or ceiling material.
FIG. 5A is an enlarged perspective view of an embodiment of the clip.

As shown in FIG. 4, at least one pair of slots 40 between corresponding tabs 30 of a bracket 20 may be at the same height or level to engage a side of the hat channel C of a preset or first height H. The tabs 30 with the pair of slots 40 engage at two spaced locations of the hat channel C. With the pair of slots 40 of respective tabs 30 of a bracket 20 engaging the hat channel C, the bracket 20 can be maintained in position at the appropriate height to position the fixture frame 12 such as for example adjacent the top surface of the ceiling material M and/or bottom B of the hat channel C. In addition to the first pair of slots 40, each pair of tabs 30 may include one or more additional pairs of slots 40 that may operate together to engage one or more hat channels of different heights or styles. In the embodiment shown, each tab 30 includes three slots 40 spaced along the distal free end 32 such that one bracket 20 may be used in at least three applications in which each pair of slots correspond to three different heights H of the hat channels that may be used in a variety of applications. FIG. 5 illustrates a hat channel C of a different or second height H, more specifically a smaller height from FIG. 4, where another or second pair of slots engage in application. Further, it should be understood that a bracket 20 may only include one slot 40 per tab 30. In use, the corresponding height of the slot 40 allows proper placement of the fixture frame 12 relative to the ceiling material M and/or channel bottom B without or reduced vertical adjustment.

As illustrated in the figures, in some embodiments of the bracket 20 the tab 30 may also include a lever 50. One or more levers 50 may allow the user to position the tab 30 with slots 40 into and/or out of engagement with the hat channels C. This may allow the user to manually pivot the tab 30 by hand between desired positions without or minimizing the use of tools. In the embodiment shown, the lever 50 extends from adjacent the hinge 33 and extends in the direction opposite of the distal free end 32. Although the lever is shown in detail in the figures, it is merely representative of some embodiments, and it is to be understood that there are a variety of shapes, sizes, orientations, constructions, and quantities which may be used and still be within the scope of the teachings herein. For example, although the lever is positioned at the upper edge of the tab it may be a variety positions relative to the remainder of the tab and/or portions of the bracket.

The tab 30 may further include one or more ribs or embossments 35 in a variety of embodiments. One or more ribs 35 may strengthen the tab 30 to allow for pivoting or movement of one or more portions of the tab. One embodiment of the rib 35 shown extends parallel or substantially vertical to the hinge 33. Further the rib 35 may extend perpendicular to the hinge 33 within a portion of the lever 50 of the tab 30. The one or more ribs 35 may be adjacent the proximal end 31 of the tab 30 and/or spaced from the one or more slots 40. Although the ribs are shown in detail in the figures, it is merely representative of some embodiments, and it is to be understood that there are a variety of shapes, sizes, orientations, constructions, and quantities which may be used and still be within the scope of the teachings herein.

Figure 1:
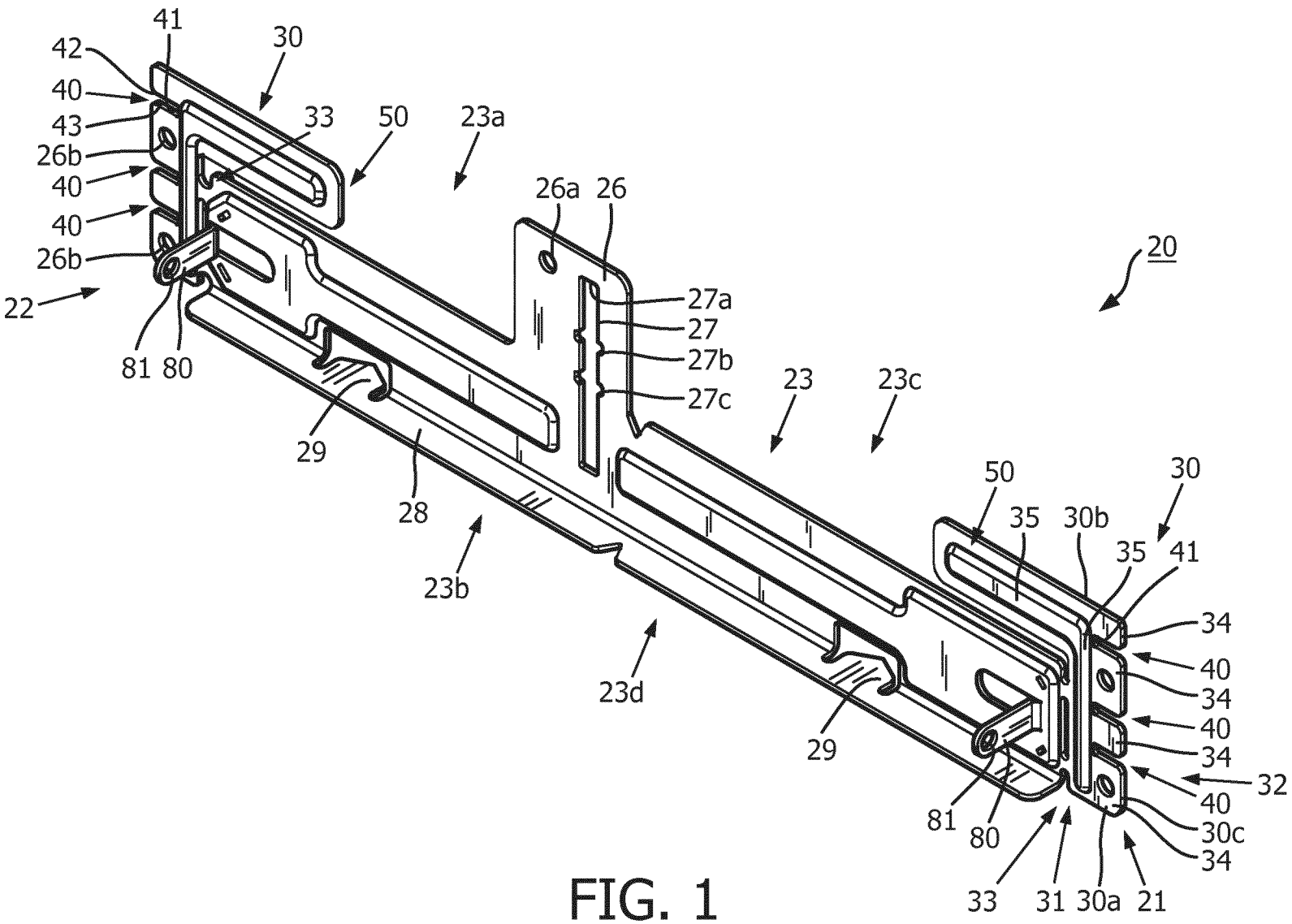
FIG. 1 is a perspective view of a side of a bracket for a hat channel luminaire fixture assembly for a luminaire fixture, illustrating an un-deployed position.
Figure 2:
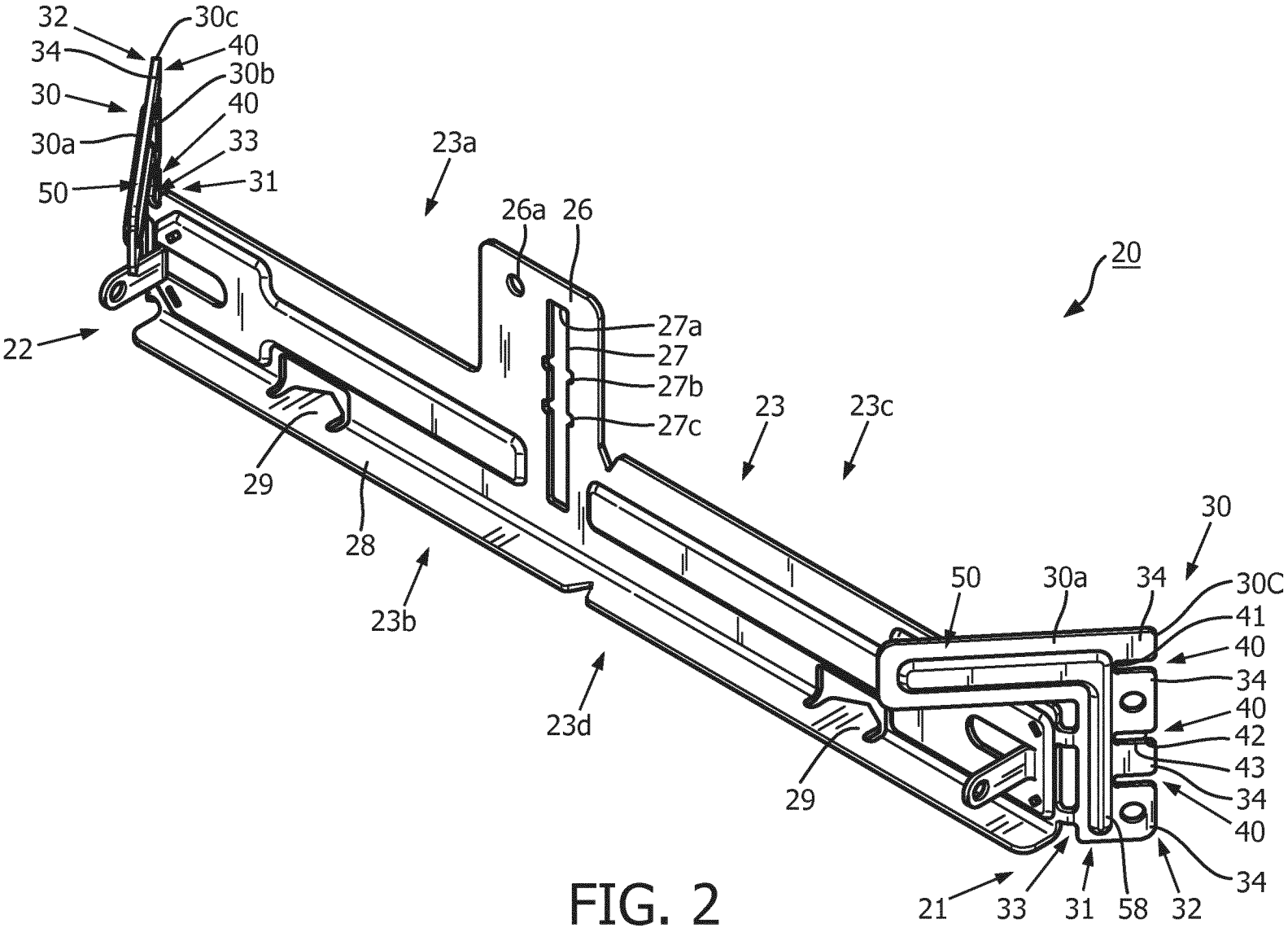
FIG. 2 is a perspective view of the bracket of FIG. 1, illustrating a deployed position.
Figure 3:
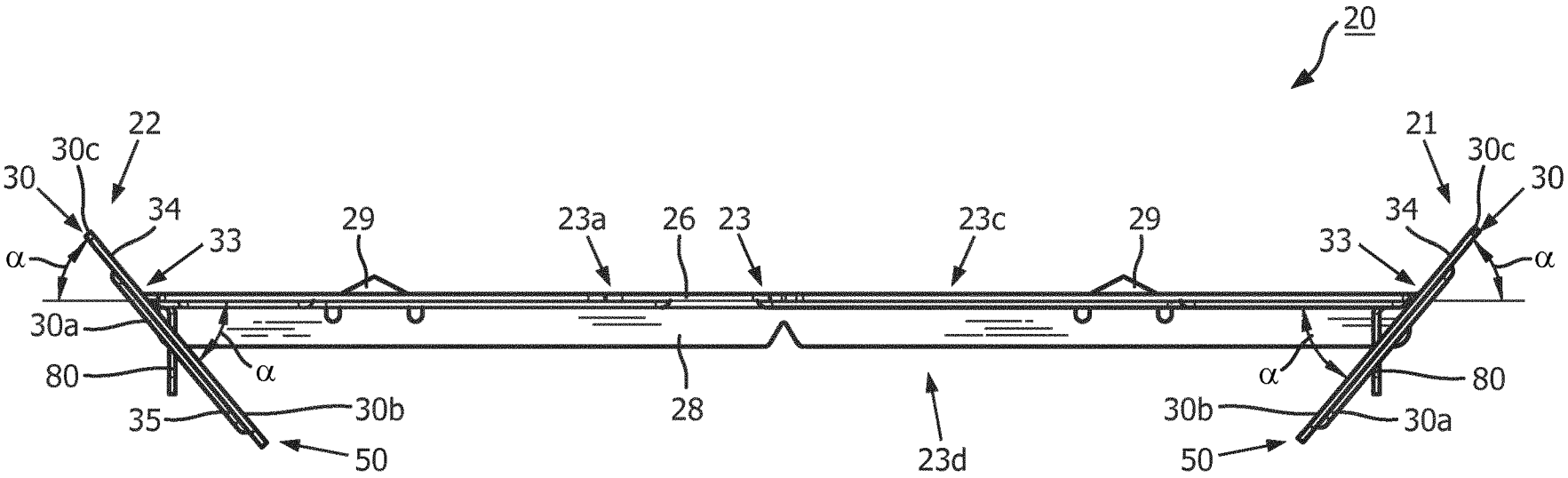
FIG. 3 is a top view of the bracket of FIG. 1, illustrating a deployed position.

Each tab 30 is positionable between an un-deployed position and a deployed position. In the deployed position as shown in FIGS. 2-4A, the tab engages the hat channel C or more of the hat channel C than when in the un-deployed position (FIG. 1). One or more interior surfaces, not limited to surfaces 41, 42, and/or 43, of the one or more slots 40 may receive at least a portion of the flange F. The outer surface 30*c* of the distal free end 32 may also engage the outer wall of the hat channel C in some embodiments. For example, the outer surface 30*c* of the tab 30 with one or more slots 40 may extend away from and be angled relative to the remaining portion of the bracket and engage the wall between the flange F and bottom B. In the deployed position as more clearly shown in FIG. 3, the tabs 30 with slots 40 are positioned in one embodiment at an angle α relative to and substantially out of the vertical plane of the elongated body 23. The angle α may be a variety of transverse angles relative to the substantially vertical plane to about, but not limited to, 90 degrees, preferably between about 90 and 5 degrees. In the deployed position, the tabs 30 project outwardly from the outward facing first side 23*c* or living hinge 33 and thereby may increase the overall width of the bracket 20 relative to the un-deployed position. If used, the lever 50 also may angle relative to the living hinge in the deployed position as shown. In the deployed position, the lever is positioned at an angle α from the inward facing second side 23*d* or hinge 33. Although the angle or distance of pivot of the lever 50 may be substantially the same as the remaining portion of the tab 30 extending outward from the living hinge 33 as shown, it is understood that the angles may be different. Further the lever 50 position in the deployed position may be a variety of positions relative to the body or remaining portions of the tab. Further, in some embodiments the overall length of the bracket may be smaller in the deployed position than in the un-deployed position.

In the un-deployed position as shown in FIG. 1, the tabs 30 may be at least partially disengaged from the hat channel C or in a first position different from the deployed or second position (FIGS. 2-4A). The tab 30 or portions thereof may be positioned in substantially the same vertical plane of the elongated body 23. The tab 30 with slots 40 may extend horizontally outwardly away from a respective end, 21 and/or 22, substantially in the same plane as the elongated body 23 with the tab lever 50, if used, extending in the opposite direction. In the embodiment shown, the lever 50 portion of the tab 30 may be positioned above and along the upper edge 23*a* of the elongated body 23. Thus, the slots (40) provide a vertical adjustment of the bracket 20 and the tab 30 with the hinge 33 provides a horizontal adjustment of said bracket 20. It should be understood that the tab may be in a variety of positions and orientations when in the un-deployed position and still pivot a variety of angles to engage the hat channel C.

When a pair of tabs 30 are deployed from the un-deployed position relative to the elongated body 23, each tab 30 pivots about the vertical axis or respective hinge 33 to extend outwardly therefrom. As more clearly shown in FIG. 3, the tab 30 adjacent the first end 21 may pivot in the counter-clockwise direction to deploy and the tab 30 adjacent the second end 22 may pivot in the clockwise direction to deploy. Alternatively, the tabs may pivot in the same direction. Together in the deployed position (FIGS. 4 and 4A), the slots 40 of the respective tabs 30 engage the hat channel C or more specifically the slots 40 may receive the flange F of the hat channel C with one or more fingers 34 straddling the upper and lower portions of the flange F. The slots 40 of the tabs 30 allow the bracket 20 to maintain or temporality maintain the bracket in position relative to the hat channel C.

Referring now to FIG. 4, one or more brackets 20 are shown which may define portions of the luminaire fixture assembly 10. The luminaire fixture assembly 10 generally comprises a fixture frame 12 interposed between a first hanger bar assembly 70 and a second hanger bar assembly 71. The fixture frame 12 generally comprises a pan structure having an aperture 14 for receiving a reflector and lamp assembly (not shown). The fixture frame 12 is depicted as generally centrally positioned between the hanger bar assemblies 70, 71 but may be offset between the assemblies 70, 71. A variety of attachments such as but not limited to screws, clips, fasteners, and the like may be used to secure the frame to at least one of the hanger bar and/or bracket. Further, the fixture frame 12 may be positioned centrally between brackets 20 or offset toward either side. The exemplary fixture frame 12 is generally flat and includes a mounting surface upon which a junction box 18 positioned. However, one skilled in the art should realize that various alternative fixture frames and/or hanger bar assemblies could be utilized, in combination with one or more brackets, to mount the frame within hat channel support structure or the like. Likewise, various types of junction boxes may be utilized which may vary in shape and size according to the need of the designer and the space requirements therein. For example, the fixture frame 12 and junction box 18 may be formed from a single blank of metal.

A variety of frame structure may engage the reflector positioned in the aperture 14. One embodiment shown extending from the peripheral edge of the aperture 14 are a plurality of reflector or trim grips 17 which engage a reflector positioned in the aperture 14. Each grip 17 has a plurality of teeth for engaging a reflector (not shown). The trim may include, for example, downlight or wall wash reflectors. Likewise the trim may be utilized with lenses such as specular clear, clear diffuse or matte white finishes. The grips 17 pivot at the fastener connection to the fixture frame 12 so that in the position shown the teeth of the grips 17 catch the reflector. However, by rotating the reflector the grips 17 rotate at the fastener until they disengage the reflector allowing removal of the reflector and access to structure above the ceiling.

The junction box 18 may have a door 18*a* for accessing the interior portion of the box 18 and making wiring connections therein between lamp wiring extending from a socket cup 19 and the power source wiring entering the junction box 18. Mounted opposite the door 18*a* on the junction box 18 is control device 16, such as ballast. The ballast limits the flow of current in an electrical circuit, in this instance the lighting circuit, to limit current to an appropriate level. The control device 16 is shown connected directly to the junction box 18 such that wiring from the control device 16 extending through the junction box wall may be in electrical communication with power source wiring as well as wiring extending to the socket cup 19. However, the control device 16 may be spaced from the junction box 18 and wiring from the control device 16 may extend through a knock-out in the junction box 18 if such design is preferred. Alternatively, other types of control devices 16 may or may not be utilized. In the scenario where a control device is used, a dimming ballast, a transformer, an LED driver or other known control device may be utilized. Additionally, a battery back-up and charging circuit may be utilized on the junction box 18 or spaced therefrom. The socket cup 19 may house a lamp socket for mounting a light source. With a light source (not shown) extending from the socket cup 19, the lamp and socket cup 19 are positioned over the reflector (not shown) so that the lamp is positioned within the reflector and within the aperture 14.

One embodiment of a mounting bracket 20 may include one or more arms 80 projecting from the inside surface or second side 23*d* of the bracket to engage one or more of the hanger bar assemblies 70, 71. Each arm 80 has an aperture 81 which allows for connection of the arms 80 and the hanger bar assemblies 70, 71 by use of a fastener or the like. However, other engagement structures may be utilized to connect the bracket 20 to the first and second hanger bar assemblies 70, 71. The first hanger bar assembly 70 and the second hanger bar assembly 71 each comprise a first end 72 and a second end 73. The brackets 20 are disposed at ends 72, 73 of the hanger bar assemblies 70, 71. Each of the hanger bar assemblies 70, 71 comprises at least one hanger bar. In the exemplary embodiment, first and second hanger bars 74, 75 are utilized to define each hanger bar assembly 70, 71. The first hanger bar 74 slides relative to the second hanger bar 75 so that the hanger bar assemblies 70, 71 may be utilized within hat channel grids, joists or other types of ceiling support systems which may vary in length between members. In the exemplary embodiment, each bracket 20 includes two hanger bars 74, 75 extending therefrom and defining a U-shaped sub-structure. When the two sub-structures are connected by slidably connecting the opposed bars 74, 75 and engage with portions of the fixture frame 12, the pan is held captive between the opposing brackets 20.

In another embodiment, the tabs 30 of the bracket 20 may be combined with a variety of locking mechanisms 60 to secure the bracket 20 to a hat channel C. One embodiment of the locking mechanism is shown as a clip 62 and/or a fastener 63. One embodiment of the clip 62 is shown in FIG. 5A. In some embodiments bracket 20 may include an upstanding portion 26. The exemplary upstanding portion 26 extends substantially perpendicular to the body 23 and further comprises one or more holes or apertures 26*a*. The holes or apertures 26*a* allow for alternate mounting options or for pass-through of alternate fastening hardware. The exemplary upstanding portion 26 is generally vertically extending with respect to the bracket 20. The upstanding portion 26 may be offset from the center of the bracket 20. An adjustment slot 27 is positioned within the bracket 20 allowing clips 62 to operably engage the bracket 20 and clamp to the hat channel C or other ceiling support structure. The adjustment slot 27 is substantially vertically oriented and extends upwardly from the elongated body 23 through the upstanding portion 26. However, it should be understood that the slot 27 may be positioned completely within the body 23 if the bracket 20 is sized in a vertical dimension to completely encompass the slot 27. One embodiment of a clip and fastener incorporated by reference may be from U.S. Pat. No. 7,874,708. It should be understood that a variety of locking mechanisms 60 may also be used with the tabs 30 of the bracket 20 to secure to a hat channel C. Other locking mechanisms may include, but is not limited to, wire, screws, fasteners, or the like. Such locking mechanisms 60 may be secured manually by hand or with tools to fix the bracket 20 to the hat channel C. One embodiment of a manually locking mechanism 60 may include the clip 62 and fastener 63 secured manually by hand.

In some embodiments the bracket 20 may include one or more predetermined clip 62 positions relative to the bracket, or more specifically the vertical slot 27, corresponding to the respective tab's slots 40 engaging the hat channel flange F. With the clip 62 position corresponding to the slots 40 of the tabs 30 at a hat channel height H, the bracket 20 may be supported in three locations based upon the height H of a variety of hat channels C used in the application. In the one embodiment shown, the slot 27 can engage the clip 62 at three locations corresponding to the relative height H of the hat channel C. As shown in FIG. 4, an upper edge 27*a* of the slot 27 may engage the clip neck 62*a* when the upper slot 40 also engages the flange F of a channel C of a first or largest height of the channel C to properly position the bracket 20 relative to the channel C. As shown in FIG. 5, an upper horizontal slot 27*b*, transverse to the vertical slot 27, engages the neck 62*a* of the clip 62 when the middle slot 40 engages the flange F of a channel C of a smaller height than the channel of FIG. 4. Although not shown, it should be understood that a lower horizontal slot 27*c*, transverse to the vertical slot 27, engages the neck 62*a* of the clip 62 when the lower slot 40 engages the flange F of a channel with a smaller height than the channel of FIG. 5. In use, the head 62*b* of the clip 62 may not allow the clip 62 to be pulled through the slot 27 while still allowing vertical adjustment between one or more clip securement positions. When the clip neck 62*a* is positioned properly corresponding to the hat channel height H, the clip neck 62*a* is wedged through the corresponding one or more horizontal slots 27*b*, 27*c* or adjacent upper edge 27*a* by tightening the fastener 63 through an aperture 62*c* defined by the body 62*d*. Although the horizontal slots and abutment edges of the slot 27 are shown in one embodiment, it should be understood that the structure positioning the clip at one or more heights and/or the engaging clip if used is merely representative of some embodiments, and it is to be understood that there are a variety of shapes, sizes, orientations, constructions, and quantities which may be used and still be within the scope of the teachings herein. For example, the uppermost position of the clip could be a horizontal slot spaced from the upper edge of the slot 27 instead of the upper edge 27*a* as shown in the one embodiment. Further, the narrowing of the neck 62*a* of clip 62 as shown may be a variety of constructions to wedge into or engage the bracket.

Referring now to FIG. 4, one embodiment of the luminaire fixture assembly 10 is mounted between two hat channels C, specifically in this embodiment hat channels are of the same height H. It should be understood that the hat channels C may be of different height H and the tabs 30 of the brackets 20 may still be used to engage the hat channels. If a clip 62 is used, the clip 62 and bracket 20 may combine to form an inverted U-shape to receive at least one side of the hat channel C. With the luminaire fixture assembly 10 hanging on the respective hat channel C and the tabs of the brackets in the un-deployed position (FIG. 1), the tabs 30 may be deployed to engage the respective slots 40 therein with the outwardly projecting flange F of the hat channel C. Alternatively, the tabs 30 may be deployed before engagement of the clip 62 or locking mechanism. The one or more slots 40 are selected to the height H of the channel C to properly position the fixture frame 12 at the appropriate height. With this design, the bracket 20 and/or clips 62 receives hat channels of various heights, widths, and styles. Further, the clip 62 is positioned vertically within the slot 27 to a position corresponding to the selected slot 40 of the tab and channel height. Shown in FIG. 4, the clip 62 engages upper edge 27*a*. With the lower end of the clip 62 disposed over the side of the hat channel C, the clip 62 wedged into the slot 27 at the appropriate height, and the slots 40 receiving the hat channel flanges F, a wing nut 64 is tightened to secure the bracket in position. Tightening the wing nut 64 with the fastener 63 forces the clip and bracket, more specifically portions of the tabs 30, against the upper portion of the hat channel C to apply pressure. With the clip 62 spaced between a pair of tabs 30, three points of contact and pressure may be applied to the hat channel C. Although the bracket 20 and clip 62 are shown in one embodiment, a variety of locking mechanisms, if used, may be used to secure the bracket to the hat channel.

Although the bracket 20 is shown in one application with a hat channel C, it should be understood that the bracket 20 may be used in a variety of applications with or without a hat channel C or the like if desired. For example a device having a pair of brackets 20 may use one bracket with a hat channel and the other bracket secured to a ceiling joist. As such in some applications, one or more brackets 20 with one or more tabs 30 may be used in applications that the bracket is mounted with the tabs maintained in the un-deployed position. For example, the bracket 20 with un-deployed tabs 30 may be attached to an inverted T-bar for drop ceilings along with a clip, if used. Further for example, in some embodiments of the bracket may include a foot 28 extending from a lower edge to receive a ceiling tile. Further, some embodiments of the brackets may include locator tabs 29 at lower portions of the outer face of the elongated body. These tabs 29 may extend substantially perpendicular to the elongated body at two positions to position against a lower surface of ceiling joists when utilized in alternative construction. Alternatively, the tabs 29 may contact a portion of the hat channel C. Further, the bracket may be adjustable for use with wooden joist applications. As such in some embodiments the bracket may include fastener holes 26*a* and/or 26*b* allowing for connection of the bracket to the joist. Screws, nails, or other such fasteners may be utilized with the fastener holes in order to attach the bracket with un-deployed tabs to a joist or other such ceiling structure.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of" or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of" when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

The invention claimed is:

1. A hat channel mounting bracket for a luminaire fixture frame, comprising:

a bracket;

said bracket having an elongated body with opposing ends, a tab is connected to each said opposing end by a living hinge, and wherein each said tab includes a plurality of slots, wherein said plurality of slots provide a vertical adjustment of said bracket, based on a respective slot of the plurality of slots, and said living hinge provides a horizontal adjustment of said bracket; and each said tab with the plurality of slots is positionable from an un-deployed position to a deployed position about said living hinge, wherein when in said un-deployed position said plurality of slots of each said tab are disengaged from a respective first or second hat channel, and wherein when in said deployed position said plurality of slots of each said tab engages the respective first or second hat channel.

2. The hat channel mounting bracket of claim 1 wherein when in said un-deployed position each said tab is substantially in a vertical plane of said elongated body and wherein when in said deployed position each said tab is substantially transverse to said vertical plane of said elongated body.

3. The hat channel mounting bracket of claim 1 wherein each said tab includes a lever.

4. The hat channel mounting bracket of claim 1 wherein each said tab pivots in a direction opposite relative to each other about said living hinge when positioning from said un-deployed position to said deployed position.

5. The hat channel mounting bracket of claim 1 wherein said plurality of slots are adjacent a distal free end of said tab opposite said living hinge.

6. The hat channel mounting bracket of claim 1 wherein said tab includes one or more ribs.

7. The hat channel mounting bracket of claim 1 further comprising a clip and a fastener, wherein said clip is vertically adjustable relative to said bracket, said clip extending through a slot within said elongated body of said bracket, and said fastener extends through said bracket and said clip to engage the respective first or second hat channel.

8. The hat channel mounting bracket of claim 7 wherein a clip engages at least one of an upper edge of one or more transverse slots of said slot corresponding to said plurality of slots of each said tab.

9. The hat channel mounting bracket of claim 1 wherein said plurality of slots of said tabs opens onto two opposing surfaces of each said tab and onto an outer surface of said tab.

* * * * *